US009249640B2

(12) United States Patent
Noffke et al.

(10) Patent No.: US 9,249,640 B2
(45) **Date of Patent: *Feb. 2, 2016**

(54) PRESSURE ACTIVATED CONTINGENCY RELEASE SYSTEM AND METHOD

(75) Inventors: Richard P. Noffke, Plano, TX (US); Arthur T. Stautzenbeger, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 432 days.

This patent is subject to a terminal disclaimer.

(21) Appl. No.: 13/812,140

(22) PCT Filed: Apr. 9, 2012

(86) PCT No.: PCT/US2012/032782

§ 371 (c)(1), (2), (4) Date: Jan. 24, 2013

(87) PCT Pub. No.: WO2013/154527

PCT Pub. Date: Oct. 17, 2013

(65) Prior Publication Data

US 2013/0264071 A1 Oct. 10, 2013

(51) Int. Cl.
*E21B 23/00* (2006.01)
*E21B 17/06* (2006.01)

(52) U.S. Cl.
CPC ..... *E21B 23/00* (2013.01); *E21B 17/06* (2013.01)

(58) Field of Classification Search
USPC ..... 166/381
See application file for complete search history.

(56) References Cited

U.S. PATENT DOCUMENTS

| | | | | |
|---|---|---|---|---|
| 4,940,089 | A | 7/1990 | Terral | |
| 5,074,362 | A * | 12/1991 | Allwin | 166/382 |
| 5,787,982 | A | 8/1998 | Bakke | |
| 6,425,443 | B1 | 7/2002 | Hill et al. | |
| 8,485,266 | B2 | 7/2013 | Stautzenberger et al. | |
| 8,490,692 | B2 | 7/2013 | Stautzenberger et al. | |
| 2010/0282474 | A1 * | 11/2010 | Mohr | 166/360 |

FOREIGN PATENT DOCUMENTS

WO 2013154527 A1 10/2013

OTHER PUBLICATIONS

Foreign Communication From a Related Counterpart Application, International Search Report dated Dec. 18, 2012, International Application No. PCT/US12/32782 filed on Apr. 9, 2012.

* cited by examiner

*Primary Examiner* — Taras P Bemko
(74) *Attorney, Agent, or Firm* — Scott Richardson; Baker Botts L.L.P.

(57) ABSTRACT

A release mechanism for use with a downhole component in a wellbore environment comprises a shifting sleeve disposed about a mandrel, where the shifting sleeve is torsionally locked with respect to the mandrel, a collet prop disposed about the mandrel and engaged with the shifting sleeve, where the engagement between the collet prop and the shifting sleeve is configured to torsionally lock the collet prop with respect to the shifting sleeve, and a collet engaged with the collet prop, wherein the collet couples the mandrel to the downhole component.

20 Claims, 6 Drawing Sheets

PRESSURE ACTIVATED CONTINGENCY RELEASE SYSTEM AND METHOD

CROSS-REFERENCE TO RELATED APPLICATIONS

This application is a 371 National Phase application of PCT/US2012/032782, entitled "Pressure Activated Contingency Release System and Method", by Richard P. Noffke, et al., filed Apr. 9, 2012, in the United States Receiving Office.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations that contain hydrocarbons to allow for recovery of the hydrocarbons. Once the wellbore has been drilled, various completion operations may be performed to configure the well for producing the hydrocarbons. Various tools may be used during the completion operations to convey the completions assemblies and/or components into the wellbore, perform the completion operations, and then disengage from the assemblies and/or components before retrieving the tools to the surface of the wellbore. Various mechanisms may be used to disengage the tool from the completion assemblies. However in some instances, the disengagement mechanism may not operate as intended, which may require that the completion assembly be removed from the wellbore with the tool or the tool be left in the wellbore with the completion assembly.

SUMMARY

In an embodiment, a release mechanism for use with a downhole component in a wellbore environment comprises a shifting sleeve disposed about a mandrel, where the shifting sleeve is torsionally locked with respect to the mandrel, a collet prop disposed about the mandrel and engaged with the shifting sleeve, where the engagement between the collet prop and the shifting sleeve is configured to torsionally lock the collet prop with respect to the shifting sleeve, and a collet engaged with the collet prop, wherein the collet couples the mandrel to the downhole component.

In an embodiment, a release mechanism comprises a shifting sleeve disposed about a mandrel, where the shifting sleeve and the mandrel are configured to substantially prevent rotational movement of the shifting sleeve about the mandrel, and where the shifting sleeve is configured to shift between a first position and a second position with respect to the mandrel. The release mechanism also comprises a collet prop disposed about the mandrel, where the collet prop is retained in engagement with a collet and the shifting sleeve when the shifting sleeve is in the first position, and where the collet prop is configured to longitudinally translate in response to a rotational force when the shifting sleeve is disposed in the second position.

In an embodiment, a method comprises longitudinally translating a shifting sleeve out of engagement with a collet prop, wherein the shifting sleeve is disposed about a mandrel; applying a rotational force to the collet prop or the mandrel when the collet prop is out of engagement with the shifting sleeve; longitudinally translating the collet prop based on the rotational force; and disengaging the collet prop from a collet based on the longitudinal translation of the collet prop.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
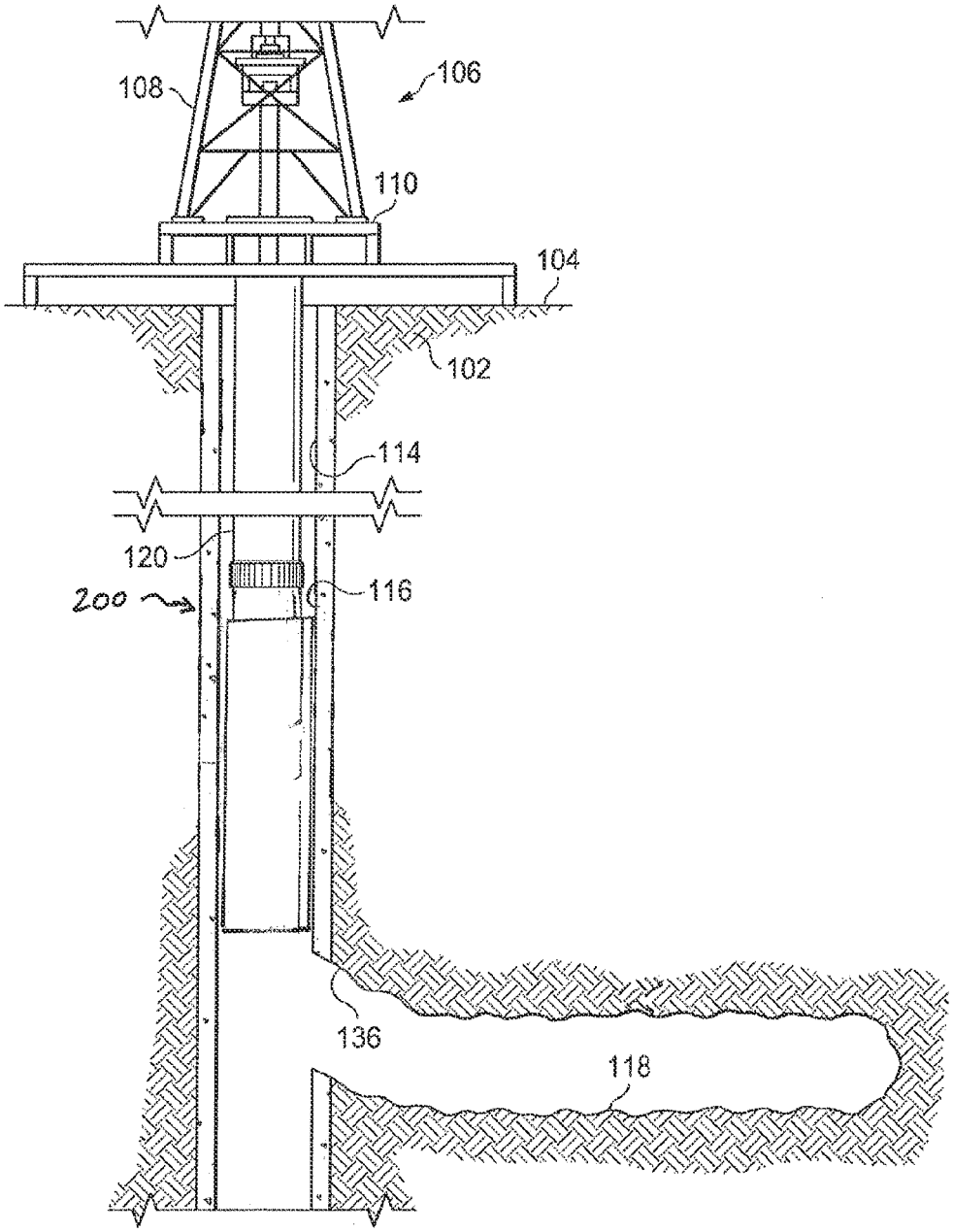
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings.

Several tools used in a servicing operation may comprise a collet configured to engage one or more other components. For example, a completion tool and/or a retrieval tool may comprise a collet having one or more lugs configured to engage a corresponding recess in a component for conveyance within the wellbore. The component may be conveyed into the wellbore and/or conveyed out of the wellbore for retrieval to the surface. A tool comprising a collet may comprise a collet prop to engage and maintain the collet in an engaged position. When the collet is ready to be released, the collet prop may be disengaged from the collet, thereby allowing the collet to be released from the component. The collet prop may be actuated through the use of a mechanical force supplied to the tool through a wellbore tubular extending to the surface of the wellbore. In some instances, the wellbore tubular and/or the tool may not be able to move, or move to the extent needed, to disengage the collet prop from the collet. In these instances, a release mechanism may be used to allow the collet prop to be disengaged from the collet, thereby allowing the tool comprising the collet to be disengaged from the component. Typically, the use of a release mechanism may involve additional steps or a sequence of actions to disengage the collet prop from the collet. These steps may be designed to reduce and/or eliminate the risk of unintentional, premature activation of the release mechanism.

As disclosed herein, the release mechanism may be configured to allow a collet prop to be disengaged from a collet through the use of a rotational force to provide a longitudinal translation of the collet prop. In order to prevent the premature actuation of the release mechanism, a torsional lock may engage the collet prop, thereby preventing the rotational motion of the collet prop relative to the mandrel about which it is disposed. In a normal operating scenario, the release mechanism may operate based on a variety of inputs. For example, a downward force may be applied to the tool, which may be used to disengage the collet prop from the collet. However, in some instances, it may not be possible to apply a downward force to the tool. In an embodiment, the torsional lock within the release mechanism may be activated using pressure to translate a shifting sleeve out of engagement with the collet prop. A rotational force may then be applied to the collet prop, which may be converted to a longitudinal translation through a force conversion mechanism to shift the collet prop out of engagement with the collet. The collet may then be disengaged from a downhole component with which it is engaged to allow the tool to be removed from the wellbore while leaving the downhole component in the wellbore. Thus, the mechanisms and methods described herein may provide a simple and effective means of releasing a downhole component from a tool. For example, the release mechanism may be used in the event that the normal release mechanism does not or cannot operate.

Turning to FIG. 1, an example of a wellbore operating environment is shown. As depicted, the operating environment comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells. In an embodiment, the wellbore may be used for purposes other than or in addition to hydrocarbon production, such as uses related to geothermal energy and/or the production of water (e.g., potable water).

A wellbore tubular string 120 including a running tool that comprises a release mechanism coupled to a downhole component may be lowered into the subterranean formation 102 for a variety of drilling, completion, workover, and/or treatment procedures throughout the life of the wellbore. The embodiment shown in FIG. 1 illustrates the wellbore tubular 120 in the form of a completion string being lowered into the subterranean formation. It should be understood that the wellbore tubular 120 is equally applicable to any type of wellbore tubular being inserted into a wellbore, including as non-limiting examples drill pipe, production tubing, rod strings, and coiled tubing. In an embodiment, the downhole component may include, but is not limited to, a liner hanger, a liner (e.g., an expandable liner), a liner patch, a screen, or any combination thereof. In the embodiment shown in FIG. 1, the wellbore tubular 120 comprising the running tool may be conveyed into the subterranean formation 102 in a conventional manner and may subsequently be released from the component using a standard release mechanism or the release mechanism as described herein.

The drilling rig 106 comprises a derrick 108 with a rig floor 110 through which the wellbore tubular 120 extends downward from the drilling rig 106 into the wellbore 114. The drilling rig 106 comprises a motor driven winch and other associated equipment for extending the wellbore tubular 120 into the wellbore 114 to position the wellbore tubular 120 at a selected depth. While the operating environment depicted in FIG. 1 refers to a stationary drilling rig 106 for lowering and setting the wellbore tubular 120 comprising the running tool within a land-based wellbore 114, in alternative embodiments, mobile workover rigs, wellbore servicing units (such as coiled tubing units), and the like may be used to lower the wellbore tubular 120 comprising the running tool into a wellbore. It should be understood that a wellbore tubular 120 comprising the running tool may alternatively be used in other operational environments, such as within an offshore wellbore operational environment. In alternative operating environments, a vertical, deviated, or horizontal wellbore portion may be cased and cemented and/or portions of the wellbore may be uncased.

Regardless of the type of operational environment in which the running tool comprising the release mechanism 200 is used, it will be appreciated that the release mechanism 200 serves to allow the running tool to be disengaged from a component, which in some embodiments may occur when a standard release mechanism cannot be actuated. The release mechanism 200 may utilize a different input than the standard release mechanism. As described in greater detail below with respect to FIG. 2, the release mechanism 200 generally comprises a shifting sleeve 202 disposed about a mandrel 204, and a collet prop 206 disposed about the mandrel 204. The coupling between the shifting sleeve 202 and the mandrel 204 may be configured to substantially prevent rotational movement of the shifting sleeve 202 about the mandrel 204 while allowing for longitudinal translation of the shifting sleeve 202 between a first position in which the shifting sleeve 202 is engaged with the collet prop 206 and a second position in which the shifting sleeve is not engaged with the collet prop 206. When the shifting sleeve 202 is in the first position, the collet prop 206 may be retained in engagement with a collet 208, and when the shifting sleeve 202 is in the second position, the collet prop 206 may be able to longitudinally translate out of engagement with the collet 208, thereby allowing the collet 208 to contract inwards and release from the downhole component 210. As described in more detail below, the longitudinal translation of the collet prop 206 may result from the application of a rotational force to the collet prop 206 and/or the mandrel 204.

Figure 2:
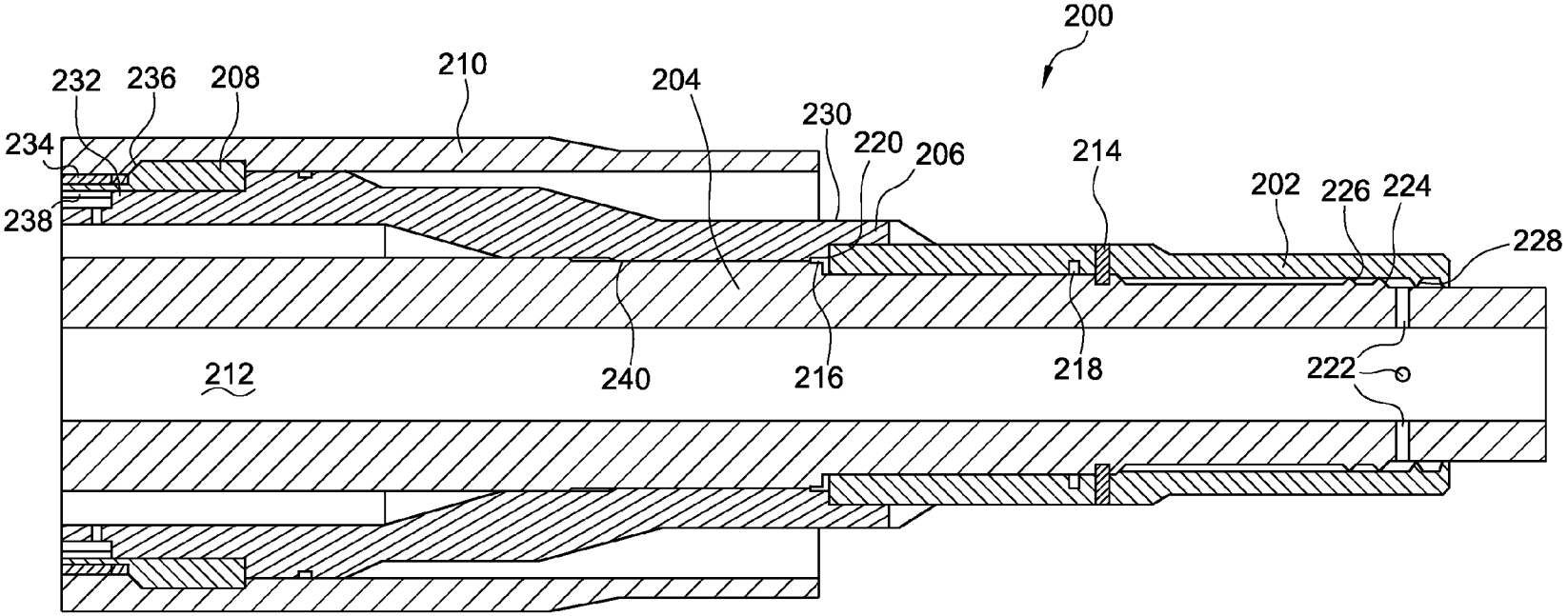
FIG. 2 is a cross-section view of an embodiment of a release mechanism.

As shown in FIG. 2, an embodiment of the release mechanism 200 comprises a mandrel 204 having a shifting sleeve 202 and a collet prop 206 disposed thereabout. Mandrel 204 generally comprises a tubular member having a flowbore 212 extending between each end of the mandrel 204. The size of the flowbore 212 may be selected to allow fluid flow therethrough at a desired rate during normal operation and/or to allow installation of the running tool and the downhole component. The mandrel 204 may comprise a generally cylindrical member, though other shapes are also possible. The ends of mandrel 204 may be configured to allow for a connection to another component above and/or below the mandrel 204. For example, the mandrel 204 may comprise an end with a threaded connection (e.g., a box or pin type connection) to allow for the mandrel 204 to be coupled to another component such as a joint of wellbore tubular used to convey the running tool into the wellbore. In some embodiments, an end of the mandrel 204 may comprise and/or be coupled to a valve seat and/or other flow isolation component to allow for flow through the flowbore 212 to be substantially isolated. In an embodiment, a ball, dart, or other corresponding flow isolation device may be conveyed through the flowbore 212 to engage the valve seat and form a seal, thereby substantially blocking flow through the flowbore 212 and allowing the flowbore 212 to be pressurized to a desired pressure.

In an embodiment, the release mechanism 200 comprises a shifting sleeve 202 disposed about the mandrel 204. The shifting sleeve 202 may generally be configured to shift or translate with respect to the mandrel 204 in response to the application of a pressure to the shifting sleeve 202 and/or the flowbore 212 of the mandrel 204, though in some embodiments, other inputs may be used to cause the shifting sleeve 202 to translate. The shifting sleeve 202 generally comprise a tubular member disposed about the mandrel 204, and the shifting sleeve 202 is generally sized to be disposed about the mandrel 204 while allowing for longitudinal movement with respect to the mandrel 204. The outer diameter of the mandrel 204 may vary along the length over which the shifting sleeve 202 can travel about the mandrel 204. The outer diameter of a first section of the mandrel 204 above (e.g., to the left in FIG. 2) the shifting sleeve 202 may be greater than the outer diameter of a second section of the mandrel 204 about which the shifting sleeve 202 can be disposed, thereby forming a shoulder 216 at the transition between the first section and the second section. A first end 220 of the shifting sleeve 202 may engage the shoulder 216 and prevent further upwards movement of the shifting sleeve 202. One or more additional shoulders, such as shoulder 218, may also be disposed along the length of the mandrel 204 over which the shifting sleeve 202 is disposed and/or can travel. One or more corresponding features disposed on the inner surface of the shifting sleeve 202 may engage the one or more additional shoulders to limit the extent of upward travel of the shifting sleeve with respect to the mandrel 204. The mandrel 204 or another downhole component coupled to the mandrel 204 may comprise one or more stops or shoulders (not shown in FIG. 2) to limit the downward travel of the shifting sleeve 202.

In an embodiment, a retaining mechanism 214 may be engaged with the shifting sleeve 202 and the mandrel 204. The retaining mechanism 214 may be configured to prevent the shifting sleeve 202 from shifting until a force exceeding a threshold is applied to the retaining mechanism 214. As described in more detail below, the shifting sleeve 202 may be substantially restrained from rotating about the mandrel 204, and the retaining mechanism 214 may then be considered to prevent the shifting sleeve 202 from longitudinally translating until a force exceeding a threshold is applied to the retaining mechanism 214. Suitable retaining mechanisms may include, but are not limited to, a shear pin, a shear ring, a shear screw, or any combination thereof. In an embodiment, one or more retaining mechanisms 214 may be used to provide the desired threshold force that is needed to initiate the translation of the shifting sleeve 202.

In an embodiment, the shifting sleeve 202 comprises a piston. One or more fluid ports 222 may provide fluid communication between the flowbore 212 within the mandrel 204 and a chamber 224 defined between the inner surface of the shifting sleeve 202 and the outer surface of the mandrel 204. A sealing engagement between the mandrel 204 and the shifting sleeve 202 may be formed through the use of sealing elements 226, 228 (e.g., O-ring seals) disposed in one or more recesses within the mandrel 204 and/or the shifting sleeve 202. The piston can be configured to shift in response to an increased pressure within the chamber 224 relative to a pressure acting on an external surface of the shifting sleeve 202. In an embodiment, the shifting sleeve 202 may be configured to shift downward in response to an increased pressure within the chamber 224. The shifting sleeve 202 may longitudinally translate with respect to the mandrel 204 with a force sufficient to shear or otherwise exceed the threshold associated with the retaining mechanism 214. One or more stops or shoulders (not shown in FIG. 2) may limit the longitudinal translation of the piston upon the application of a pressure to the chamber 224. The translation of the shifting sleeve 202 may then occur between an initial position in which the shifting sleeve 202 is engaged with the collet prop 206 and shoulder 216 and an actuated position in which the shifting sleeve 202 has shifted out of engagement with the collet prop 206 a distance sufficient to allow the collet prop 206 to disengage from the collet 208.

As noted above, the shifting sleeve 202 and the mandrel 204 may be configured to substantially prevent rotational movement of the shifting sleeve 202 about the mandrel 204. The limitation and/or restraint on the rotational movement of the shifting sleeve 202 relative to and about the mandrel 204 may be referred to as a torsional lock. Various configurations may be used to limit the rotational movement of the shifting sleeve 202 with respect to the mandrel 204. For example, the mandrel 204 may comprise one or more splines configured to engage one or more corresponding splines on the shifting sleeve 202, where the engagement of the one or more splines on the mandrel 204 with the one or more splines on the shifting sleeve 202 provide the torsional lock of the shifting sleeve 202 with respect to the mandrel 204. Alternatively, a lug and groove configuration may be used with a lug disposed on an inner surface of the shifting sleeve 202 or an outer surface of the mandrel 204 and a corresponding groove disposed on the opposite surface to receive the lug.

Figure 3A:
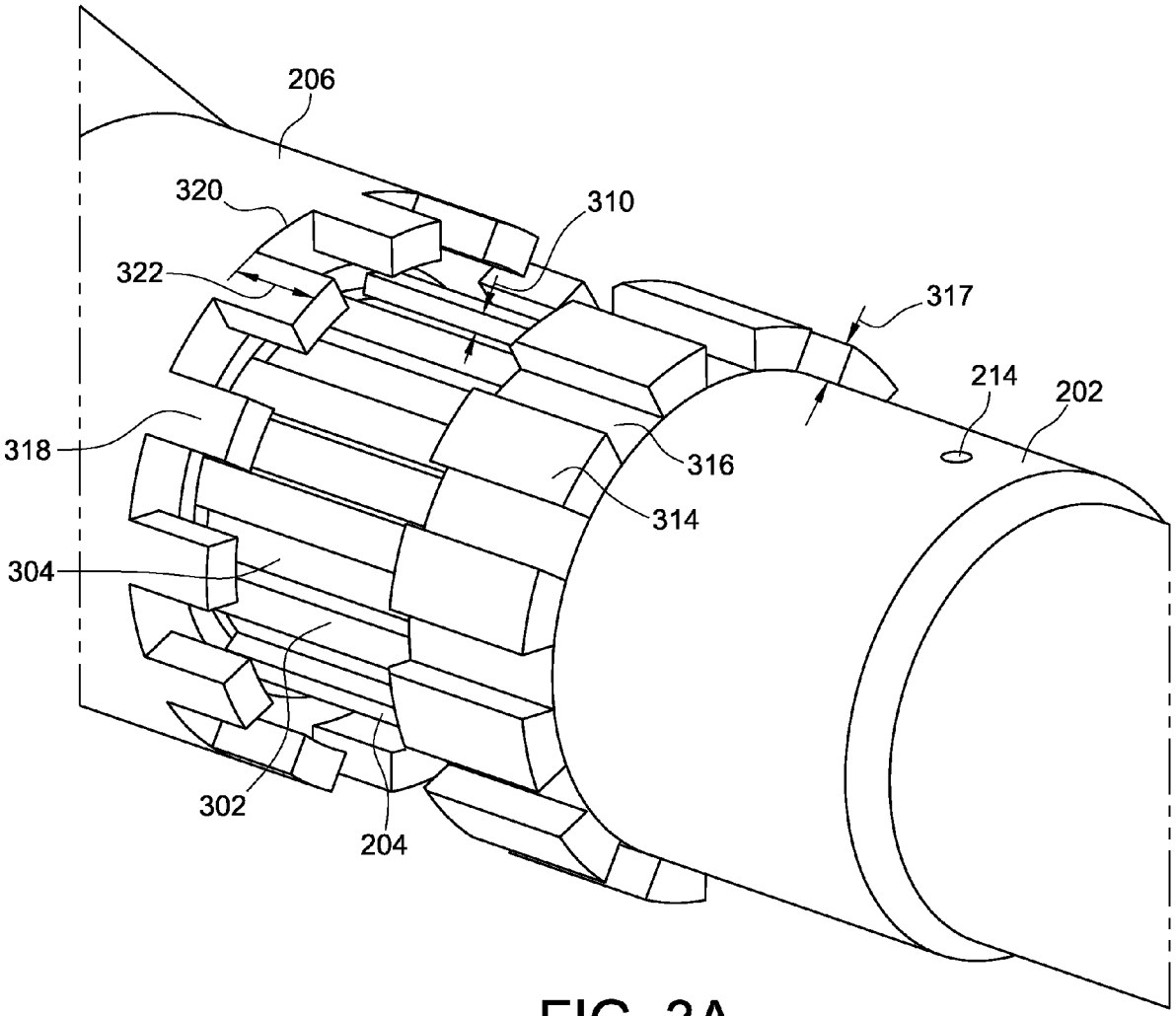
FIG. 3A is an isometric view of a first embodiment of a release mechanism.

An embodiment illustrating the use of corresponding and interlocking splines is shown in FIG. 3A. As illustrated, a first plurality of splines 302 may be formed over a portion of an outer surface of the mandrel 204. Each spline 302 has a length that extends longitudinally over a portion of the outer surface of the mandrel 204 and is substantially longitudinally aligned with the central axis of the mandrel 204. Thus, the splines 302 may also be referred to as longitudinal splines 302. Each spline 302 also has a height 310 that extends substantially radially outward from the outer surface of the mandrel 204. A recess 304 is formed between each pair of adjacent splines 302. Longitudinally aligned splines 302 may be configured to matingly engage and interlock with a set of longitudinal splines formed on an inner surface of the shifting sleeve 202. A second plurality of splines (not shown in FIG. 3A) may be formed over a portion of an inner surface of the shifting sleeve 202. Each spline has a length that extends longitudinally over a portion of the inner surface of the shifting sleeve 202 and is substantially longitudinally aligned. Thus, the splines may also be referred to as longitudinal splines, such as longitudinal splines 326 as depicted in Section A-A of FIG. 4. Each spline also has a height that extends substantially radially inward from the inner surface of the shifting sleeve 202. A recess is formed between each pair of adjacent splines. In this embodiment, the shifting sleeve 202 and the mandrel 204 may be coupled together by engaging and interlocking longitudinal splines 302 on the mandrel 204 with the corresponding longitudinal splines on the shifting sleeve 202 to form a torsionally locked engagement. The torsionally locked engagement substantially prevents relative rotational movement between the shifting sleeve 202 and the mandrel 204.

In another embodiment, a lug and groove configuration may be used to limit the rotational movement of the shifting sleeve 202 with respect to the mandrel 204. In this embodiment, one or more lugs may be formed on a portion of the outer surface of the mandrel 204. The lug may generally comprise a protrusion extending from the outer surface of the mandrel 204, and the lug may comprise a variety of shapes including circular, square, rectangular, elliptical, oval, diamond like, etc. The one or more lugs may have a height that extends substantially radially outward from the outer surface of the mandrel 204. The lug may be configured to engage and translate within a groove formed on an inner surface of the shifting sleeve 202. One or more grooves, that may or may not correspond to the number of lugs, may be formed over a portion of the inner surface of the shifting sleeve 202. Each groove has a length that extends longitudinally over a portion of the inner surface of the shifting sleeve 202 and is substantially longitudinally aligned. Thus, the one or more grooves may be referred to as longitudinal grooves. Each groove has a depth that extends substantially radially outward from the inner surface of the shifting sleeve 202 and a width that extends along the inner circumference of the shifting sleeve 202. The depth and width of the groove may be configured to receive the lug within the groove. The lug may then be free to travel within the groove while being substantially restrained from movement perpendicular to the length of the groove. In this embodiment, the shifting sleeve 202 and the mandrel 204 may be coupled together by engaging the lug on the mandrel 204 with a corresponding groove on the shifting sleeve 202 to form a torsionally locked engagement. While the lug may follow within the longitudinal groove, the interaction of the lug with the sides of the longitudinal groove may substantially prevent relative rotational movement between the shifting sleeve 202 and the mandrel 204, thereby forming a torsional lock between the shifting sleeve 202 and the mandrel 204. While described with respect to the lug being disposed on the mandrel 204 and the groove being disposed on the shifting sleeve 202, the positioning of the lug and groove could be exchanged to allow for an equivalent torsional lock between the shifting sleeve 202 and the mandrel 204.

Returning to FIG. 2, the collet prop 206 may be disposed about the mandrel 204. The collet prop 206 generally comprises a tubular member that is disposed about and engages the mandrel 204. The collet prop 206 is generally sized to be disposed about the mandrel 204, and generally extends between a first end 230 that is configured to engage the shifting sleeve 202 and a second portion 232 configured to engage and maintain a collet 208 in engagement with a downhole component 210. The second portion 232 may comprise an end of the collet prop 206, or the collet prop 206 may extend beyond the collet 208 as shown in FIG. 2. In an embodiment, the collet prop 206 may be retained in engagement with a collet 208 when the shifting sleeve 202 is in the first position, and the collet prop 206 may be able to longitudinally translate out of engagement with the collet 208 when the shifting sleeve 202 is in the second position. A first end 230 of the collet prop 206 may be configured to engage the shifting sleeve 202, and as described in more detail below, the engagement between the shifting sleeve 202 and the collet prop 206 may form a torsional lock when the shifting sleeve is in the first position. A second portion 232 of the collet prop 206 may engage the collet 208 and retain the collet 208 in engagement with the downhole component 210.

In general, a collet 208 comprises one or more springs 234 (e.g., beam springs) and/or spring means separated by slots. In an embodiment, the slots may comprise longitudinal slots, angled slots, as measured with respect to the longitudinal axis, helical slots, and/or spiral slots for allowing at least some radial compression in response to a radially compressive force. A collet 208 may generally be configured to allow for a limited amount of radial compression of the springs 234 in response to a radially compressive force, and/or a limited amount of radial expansion of the springs 234 in response to a radially expansive force. The collet 208 also comprises a collet lug 236 disposed on the outer surface of the springs 234. In an embodiment, the collet 208 used with the release mechanism as shown in FIG. 2 may be configured to allow for a limited amount of radial compression of the springs 234 and collet lug 236 in response to a radially compressive force. The radial compression may allow the springs 234 to pass by a portion of the downhole component 210 having an inner surface with a reduced diameter before allowing the collet lug to expand into a corresponding recess disposed on an inner surface of the downhole component 210. The collet lug 236 and/or the inner surface of the downhole component 210 may comprise one or more surfaces configured to engage and provide a radially compressive force to the springs 234 when the collet lug 236 contacts the downhole component 210.

Once engaged with the downhole component 210, the collet 208 may be free to radially compress unless supported by the collet prop 206. In the engaged position, the collet prop 206 may generally engage and be disposed in radial alignment with the springs 234 and/or the collet lug 236. The collet prop 206 may generally be resistant to radially compressive forces, and when the collet prop 206 is disposed in radial alignment with the springs 234 and/or the collet lug, the springs 234 may be prevented from radially compressing. When the collet lug 236 is engaged in the corresponding recess in the downhole component 210 and engaged with the collet prop 206, the collet 208 may fixedly couple the running tool to the downhole component 210. When the collet prop 206 is disengaged from the collet 208, the springs 234 may be free to radially compress and move out of the recess in the downhole component 210, thereby releasing the downhole component 210 from the running tool. The collet prop 206 may be described as being disengaged from the collet when the collet springs 234 and/or the collet lug 236 is able to radially compress out of a fixed engagement with the recess in the downhole component 210. This may include when the collet prop 206 is translated out of radial alignment with the springs 234 and/or the collet lug 236, or when one or more recesses 238 of a sufficient depth on the collet prop 206 are radially aligned with the springs 234 and/or the collet lug 236, thereby allowing the springs 234 to radially compress into the recess and disengage from the recess in the downhole component 210.

While described with respect to a collet 208 being disposed within the downhole component 210 and the collet prop 206 being disposed in radial alignment inside the collet 208, it will be appreciated that the arrangement of the part may be reconfigured without departing from the scope of the present description. For example, the collet could be disposed outside of the downhole component and engage a recess in an outer surface of the downhole component. In this embodiment, the collet prop may be disposed outside of and in radial alignment with the collet. This configuration would allow the collet prop to prevent the radial expansion of the springs and/or the collet lug to thereby maintain an engagement between the collet and the downhole component. Other configurations and arrangements may also be possible.

As shown in FIG. 2, the engagement between the collet prop 206 and the shifting sleeve 202 may be configured to torsionally lock the collet prop 206 with respect to the shifting sleeve 202, which may in turn be torsionally locked with respect to the mandrel 204. As described above, the torsional lock between the collet prop 206 and the shifting sleeve 202 is configured to restrain the collet prop 206 from rotational motion relative to the shifting sleeve 202. In an embodiment, the collet prop 206 and the shifting sleeve may comprise one or more mating and interlocking features that, once engaged, substantially prevent any rotational motion between the collet prop 206 and the shifting sleeve 202. The interlocking features may comprise a variety of configurations including the use of crenelated features on the collet prop 206 and mating crenelated features on the shifting sleeve 202. As used herein, the term "crenelated" refers to a structure comprising repeated indentations. For example, crenelated features may comprise castellations, corrugations, teeth, and the like, and the crenelated features may be aligned in the radial and/or longitudinal directions.

An embodiment of the interlocking features comprising crenelated ends of the collet prop 206 and the shifting sleeve 202 is shown in FIG. 3A. As illustrated, a first plurality of splines 314 may be formed over a portion of an outer surface of the shifting sleeve 202. Each spline 314 has a length that extends longitudinally over a portion of the outer surface of the shifting sleeve 202 and is substantially longitudinally aligned with the central axis of the mandrel 204. Thus, the splines 314 may also be referred to as longitudinal splines 314. Each spline 314 also has a height 317 that extends substantially radially outward from the outer surface of the shifting sleeve 202. A recess 316 is formed between each pair of adjacent splines 314. Longitudinal splines 314 may be configured to matingly engage and interlock with a set of crenelated features 318 formed on an end of the collet prop 206. The crenelated features 318 illustrated in FIG. 3A may take the form of castellations on the end of the collet prop 206. Each crenelated feature 318 has a length 322 that extends longitudinally from the end of the collet prop 206 and is substantially longitudinally aligned. The crenelated features 318 are configured to engage and mate with the recesses 316 on the shifting sleeve 202. A recess 320 is formed between each pair of adjacent crenelated features 318 on the collet prop 206. The recess 320 is configured to engage and mate with the longitudinal splines 314 on the shifting sleeve 202. In this embodiment, the shifting sleeve 202 and the collet prop 206 may be coupled together by engaging and interlocking the splines 314 on the shifting sleeve 202 with the corresponding crenelated features 318 on the collet prop 206 to form a torsionally locked engagement. The torsionally locked engagement substantially prevents relative rotational movement between the shifting sleeve 202 and the collet prop 206.

Figure 3B:
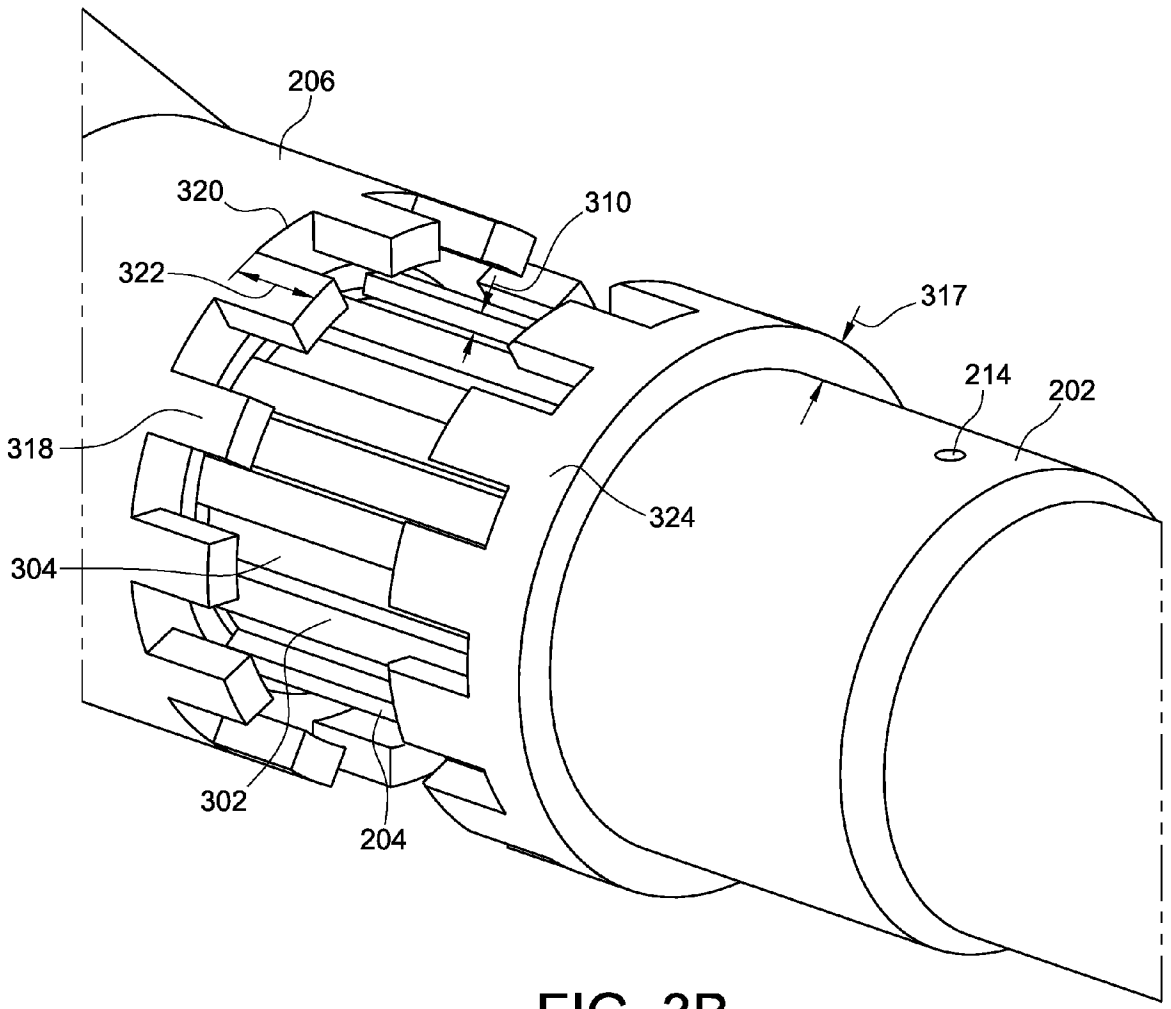
FIG. 3B is an isometric view of a second embodiment of a release mechanism.

In addition to the crenelated features described with respect to FIG. 3A, other interlocking and/or crenelated features may be used to provide a torsional lock between the collet prop 206 and the shifting sleeve 202. In an embodiment, the interlocking features could comprise corresponding and interlocking splines similar to those described with respect to the torsional lock between the mandrel 204 and the shifting sleeve 202 above. In an embodiment, the use of crenelated features such as those described with respect to the collet prop 206 in FIG. 3A could be included on both the collet prop 206 and the shifting sleeve 202. In this embodiment, depicted in FIG. 3B, the shifting sleeve 202 and the collet prop 206 could be coupled together by engaging and interlocking the crenelated features 324 on the shifting sleeve 202 with the corresponding crenelated features 318 on the collet prop 206 to form a torsionally locked engagement. In another embodiment, a single spline and crenelated feature or slot could be used to couple and form a torsional lock between the collet prop 206 and the shifting sleeve 202. In still another embodiment, one or more pins and one or more receiving holes could be used to provide a torsional lock. In this embodiment, the shifting sleeve 202 and the collet prop 206 may be coupled together by engaging and interlocking one or more pins extending from the end of the shifting sleeve 202 with corresponding receiving holes in the collet prop 206 to form a torsionally locked engagement, or vice versa. Still other embodiments useful for forming a torsional lock between the collet prop 206 and the shifting sleeve 202 may be possible.

Returning to FIG. 2, a force conversion mechanism 240 formed by the engagement of the collet prop 206 and the mandrel 204 may be configured to convert a rotational force into a longitudinal force. Once the shifting sleeve 202 is disengaged from the collet prop 206, the collet prop 206 may be free to rotate about the mandrel 204. The relative rotation may be used to longitudinally translate the collet prop 206 out of engagement with the collet (e.g., out of radial alignment with the springs 234 and/or the collet lug 236). The rotational force may be applied to the mandrel 204, the collet prop 206, and/or the downhole component 210. In an embodiment, the collet prop 206 may be substantially rotationally fixed relative to the downhole component 210, which may be substantially rotationally fixed relative to the wellbore. The mandrel 204 may then be rotated to impart a rotational force to the force conversion mechanism 240. In an embodiment, the force conversion mechanism is configured to convert a rotational force applied to the mandrel 204 and/or the collet prop 206 into a longitudinal translation of the collet prop 206 with respect to the mandrel 204. The longitudinal translation may be sufficient to disengage the collet prop 206 from the collet 208. As noted above, this may include when the collet prop 206 is translated out of radial alignment with the springs 234 and/or the collet lug 236, or when one or more recesses 238 of a sufficient depth on the collet prop 206 are radially aligned with the springs 234 and/or the collet lug 236, thereby allowing the springs 234 to radially compress into the recess and disengage from the recess in the downhole component 210. In an embodiment, the force conversion mechanism 240 may comprise a threaded engagement between the collet prop 206 and the mandrel 204, a helical groove disposed in an outer surface of the mandrel 204 and one or more corresponding lugs disposed on an inner surface of the collet prop 206, or vice versa, and/or a helical spline disposed in an outer surface of the mandrel 204 and one or more corresponding splines disposed on an inner surface of the collet prop 206.

In an embodiment, the force conversion mechanism 240 comprises a threaded engagement between the collet prop 206 and the mandrel 204. In this embodiment, the inner surface of the collet prop 206 may comprise threads that are configured to engage and mate corresponding threads on the outer surface of the mandrel 204. The collet prop may then be installed by threading the collet prop 206 onto the mandrel 204 until the collet prop 206 is engaged with the collet 208. When the shifting sleeve 202 is disengaged from the collet prop 206, the mandrel may be rotated, and the rotation of the mandrel may be converted into a downward longitudinal movement of the collet prop due to the interaction of the threads on the mandrel 204 with the threads on the collet prop 206. In an embodiment, the threads may comprise left handed threads. The use of left handed threads may allow for a rotation to the right to translate the collet prop 206, which may avoid potentially un-torqueing one or more joints of wellbore tubular used to convey the running tool into the wellbore.

In another embodiment, the force conversion mechanism 240 may comprise a helical groove disposed in an outer surface of the mandrel 204 and one or more corresponding lugs disposed on an inner surface of the collet prop 206. In this embodiment, one or more lugs may be formed on a portion of the inner surface of the collet prop 206. The lug may generally comprise a protrusion extending from the inner surface of the collet prop 206, and the lug may comprise a variety of shapes including circular, square, rectangular, elliptical, oval, diamond like, etc. The one or more lugs may have a height that extends substantially radially inward from the inner surface of the collet prop 206. The lug may be configured to engage and translate within a groove formed on an outer surface of the mandrel. One or more grooves, that may or may not correspond to the number of lugs, may be formed over a portion of the outer surface of the mandrel 204. Each groove has a length that extends circumferentially (e.g., helically, spirally, etc.) over a portion of the outer surface of the mandrel 204 and is angularly offset relative to the longitudinal axis. Thus, the one or more grooves may be referred to as longitudinal or axially offset grooves. Each groove has a depth that extends substantially radially inward from the outer surface of the mandrel 204 and a width configured to receive the lug within the groove. The lug may then be free to travel within the groove and follow the groove in the longitudinally offset path. The application of a rotational force to the mandrel 204 may cause the lug on the collet prop to follow the longitudinally offset path. When the collet prop 206 is constrained from rotational motion due to the interaction with the collet 208 and downhole component 210, the rotational force may be converted into a longitudinal force driving the collet prop 206 out of engagement with the collet 208. While described with respect to the lug being disposed on the collet prop 206 and the groove being disposed on the mandrel 204, the positioning of the lug and groove could be exchanged to allow for the same force conversion between the shifting sleeve 202 and the mandrel 204.

In still another embodiment, the force conversion mechanism 240 may comprise a helical spline disposed in an outer surface of the mandrel 204 and one or more corresponding splines disposed on an inner surface of the collet prop 206. In this embodiment, a first plurality of longitudinally offset splines may be formed over a portion of an outer surface of the mandrel 204. Each spline may have a length that extends circumferentially (e.g., helically, spirally, etc.) over a portion of the outer surface of the mandrel 204 and is angularly offset relative to the longitudinal axis of the mandrel 204. Each spline also has a height that extends substantially radially outward from the outer surface of the mandrel 204. A recess may be formed between each pair of adjacent splines. Longitudinally offset splines may be configured to matingly engage and interlock with a set of longitudinally offset splines formed on an inner surface of the collet prop 206. A second plurality of longitudinally offset splines may be formed over a portion of an inner surface of the collet prop 206. Each spline may have a length that extends circumferentially (e.g., helically, spirally, etc.) over a portion of the outer surface of the collet prop 206 and is angularly offset relative to the longitudinal axis of the mandrel 204. Each longitudinally offset spline on the collet prop 206 also has a height that extends substantially radially inward from the inner surface of the collet prop 206. A recess may be formed between each pair of adjacent longitudinally offset splines. In this embodiment, force conversion mechanism may comprise an engagement and interlocking of the longitudinally offset splines on the mandrel 204 with the corresponding longitudinally offset splines on the collet prop 206. The splines on the collet prop 206 may be free to travel within the recesses between the splines on the mandrel 204 and follow the recess in the longitudinally offset path. The application of a rotational force to the mandrel 204 and/or the collet prop 206 may cause the splines on the collet prop 206 to follow the longitudinally offset path. When the collet prop 206 is constrained from rotational motion due to the interaction with the collet 208 and downhole component 210, the rotational force may be converted into a longitudinal force driving the collet prop 206 out of engagement with the collet 208.

In an embodiment, the release mechanism 200 may be assembled by engaging the collet with the downhole component so that the collet lugs 236 are engaged with the recess in the downhole component 210. The collet prop 206 may then be engaged with the collet. For example, the collet prop 206 may be rotated onto the mandrel 204 to engage the force conversion mechanism. The shifting sleeve may then be disposed on the mandrel 204 and engaged with the collet prop 206. One or more retaining mechanisms 214 may then be engaged with the shifting sleeve 202 and the mandrel 204. The shifting sleeve 202 may be torsionally locked with respect to the mandrel 204, and the engagement between the shifting sleeve 202 and the collet prop 206 may further torsionally lock the collet prop 206 with respect to the shifting sleeve 202. Since the shifting sleeve 202 is torsionally locked with respect to the mandrel 204 and the collet prop 206, the collet prop 206 may be torsionally locked with respect to the mandrel 204. The resulting configuration of the release mechanism 200 may be as shown in FIG. 2. Once the running tool comprising the release mechanism is made up, the running tool and the downhole component may be conveyed within a wellbore and disposed at a desired location.

The downhole component 210 may then be installed and/or used during a servicing operation. At some point in the operation, the downhole component 210 may need to be disengaged from the running tool. During the servicing operation, a ball or other pressure isolating device may be disposed within the flowbore 212 of the mandrel 204 to engage a seat and increase the pressure within the flowbore 212 relative to the pressure outside of the running tool. The resulting pressure increase within the flowbore 212 may actuate the shifting sleeve 202. Alternatively, a special operation may be performed to increase the pressure within the flowbore 212 to actuate the shifting sleeve. Upon the actuation of the shifting sleeve 202, a longitudinal force may be applied to the retaining mechanism 214. When the force applied to the retaining mechanisms exceeds a threshold, the retaining mechanism 214 may fail, thereby allowing the shifting sleeve 202 to longitudinally translate out of engagement with the collet prop 206. In an embodiment, the shifting sleeve 202 may comprise a piston, and the piston may remain energized while the pressure is applied through the flowbore 212. This configuration may allow the shifting sleeve to be activated during a servicing operation while maintaining pressure within the flowbore 212 for use during the servicing operation. The release mechanism may then be configured as shown in FIG. 4.

Figure 4:
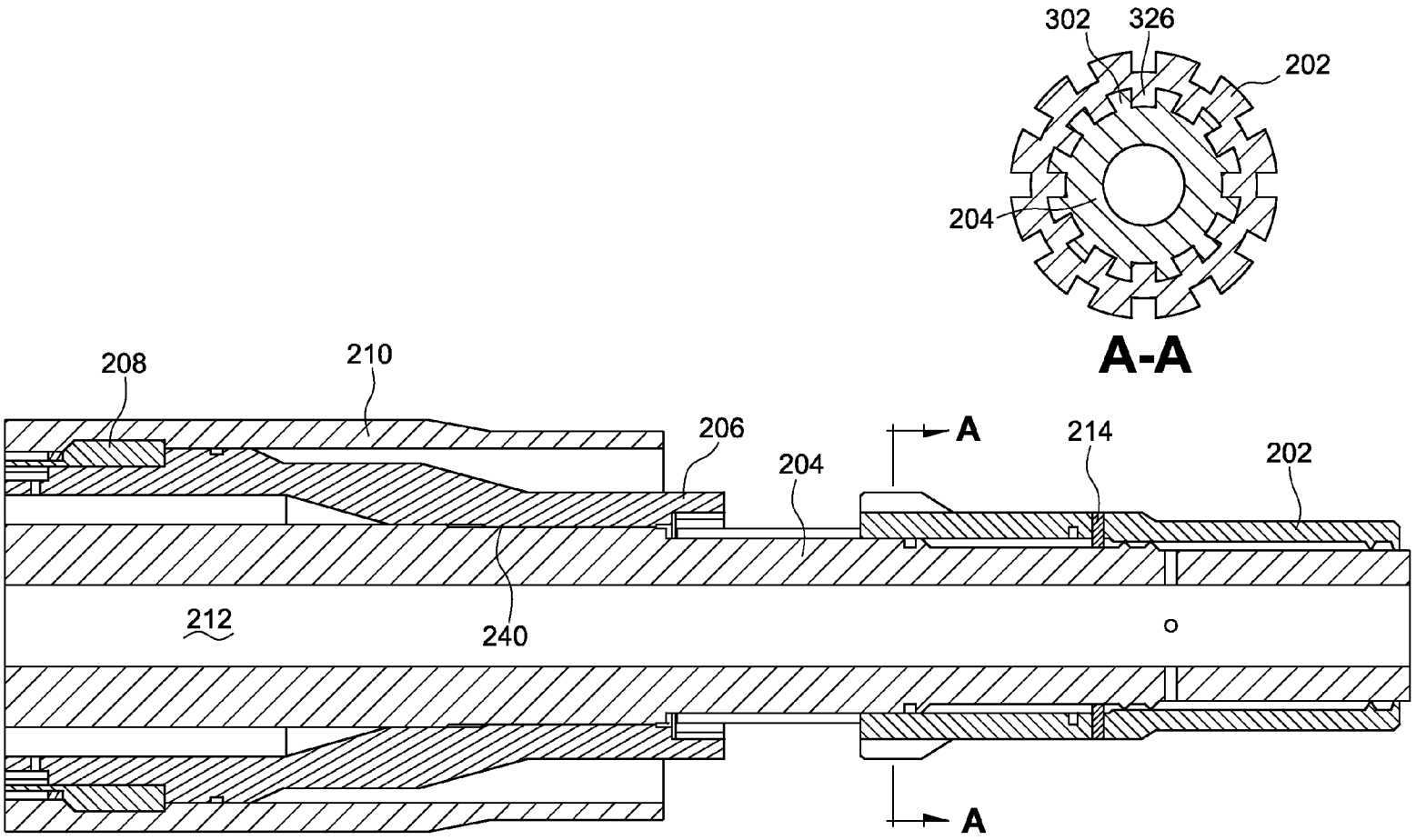
FIG. 4 is another cross-section view of an embodiment of a release mechanism.

As shown in FIG. 4, the shifting sleeve 202 may translate out of engagement with the collet prop 206, thereby disengaging the torsional lock between the collet prop 206 and the shifting sleeve 202. In a normal operating environment, the collet prop 206 may be longitudinally translated out of engagement with the collet through the downward translation of the mandrel 204, which is engaged with the collet prop 206. However, in some instances, the mandrel may not be able to be translated in a downward direction. In this case or in the event the release mechanism is desired to be used rather than setting down weight on the running tool to move the mandrel 204 downward, a rotational force may be applied to the collet prop 206 and/or the mandrel 204. The force conversion mechanism 240 may then convert the rotation force into a longitudinal force. For example, the mandrel 204 may be rotated to the right, thereby unscrewing the collet prop and driving the collet prop downward. When a sufficient amount of rotational force, and therefore rotation, has been imparted, the collet prop 206 may be disengaged from the collet 208. In this configuration, a retaining ring may also engage a retaining ring slot, thereby providing a fixed engagement between the collet prop 206, the collet 208, and the mandrel 204. The release mechanism may then be configured as shown in FIG. 5.

Figure 5:
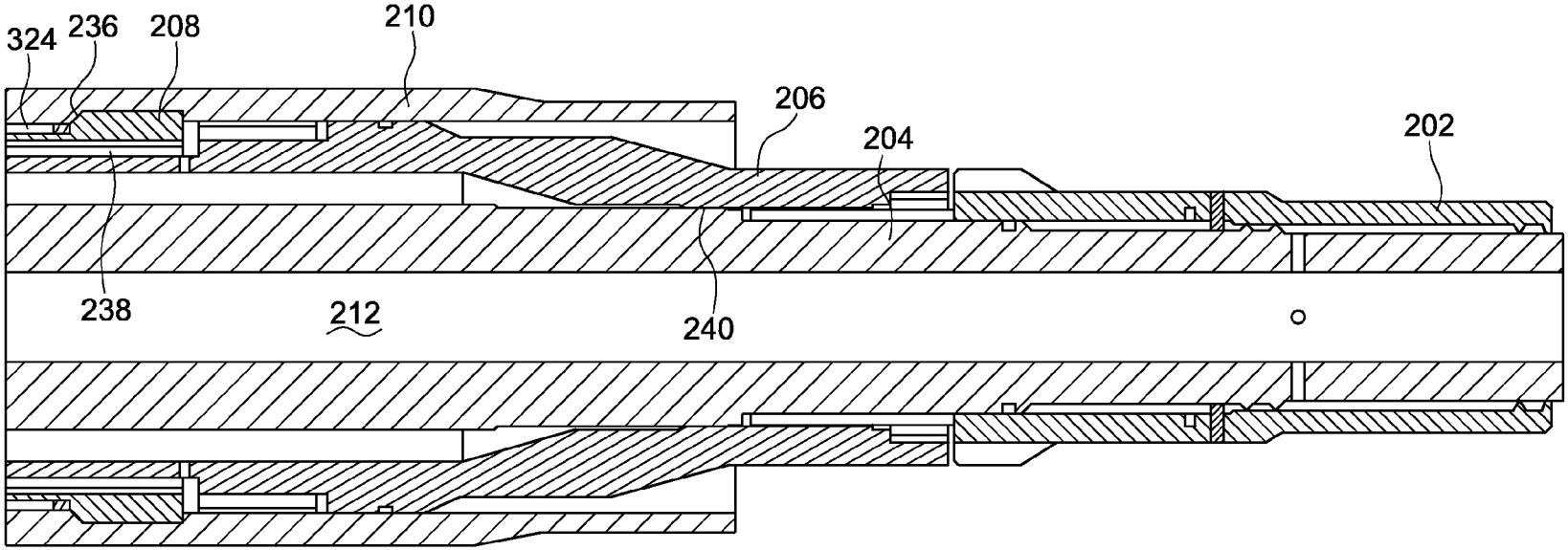
FIG. 5 is still another cross-section view of an embodiment of a release mechanism.

As shown in FIG. 5, the collet prop 206 may be disengaged from the collet 208 based on the longitudinal translation of the collet prop 206. The collet springs 234 and/or the collet lug 236 may then be able to radially compress in response to a radially compressive force. The radially compressive force may be imparted by providing an upwards force on the mandrel 204, which may be coupled to the collet 208. The retaining ring disposed in the retaining ring slot may prevent the collet prop 206 from longitudinally translating upwards to re-engage the collet 208. Due to the engagement between the collet lug 236 and the edge of the recess in the downhole component 210, the collet springs 234 and collet lug 236 may radially compress and disengage from the recess in the downhole component 210. The running tool comprising the release mechanism may then be disengaged from the downhole component 210 and conveyed upward while the downhole component remains in the wellbore.

While described in terms of disengaging a running tool from the downhole component using the release mechanism, the release mechanism may alternatively be used with other tools such as retrieval tools, work strings, completion strings, and other downhole tools where a release mechanism may be useful.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A release mechanism for use with a downhole component in a wellbore environment comprising:

a shifting sleeve disposed about a mandrel, wherein the shifting sleeve is torsionally locked with respect to the mandrel and longitudinally translatable along the mandrel between a first sleeve position and a second sleeve position;

a collet prop disposed about the mandrel, wherein when the shifting sleeve is in the first sleeve position, the collet prop is engaged with the shifting sleeve wherein and the engagement between the collet prop and the shifting sleeve is configured to torsionally lock the collet prop with respect to the shifting sleeve, and when the shifting sleeve is in the second sleeve position, the collet prop is disengaged from the shifting sleeve and is longitudinally translatable between a first collet prop position and a second collet prop position by applying a rotational force to one of the mandrel and the collet prop; and a collet, wherein when the collet prop is in the first collet prop position, the collet prop is engaged with the collet and couples the mandrel to the downhole component and when the collet prop is in the second collet prop position, the collet prop is disengaged from the collet and permits release of the mandrel from the downhole component.

2. The release mechanism of claim 1, wherein the mandrel comprises one or more splines configured to engage one or more corresponding splines on the shifting sleeve, and wherein the engagement of the one or more splines on the mandrel with the one or more splines on the shifting sleeve provide the torsional lock of the shifting sleeve with respect to the mandrel.

3. The release mechanism of claim 1, wherein the shifting sleeve comprises a piston.

4. The release mechanism of claim 1, wherein the collet prop comprises a crenelated end, wherein the shifting sleeve comprises a crenelated end, and wherein the engagement between the collet prop and the shifting sleeve comprises an engagement between the crenelated end of the collet prop and the crenelated end of the shifting sleeve.

5. The release mechanism of claim 1, wherein the collet prop is threadedly engaged with the mandrel.

6. The release mechanism of claim 1, wherein the threaded engagement between the collet prop and the mandrel comprises left handed threads.

7. The release mechanism of claim 1, wherein the downhole component comprises a liner hanger, a liner, a liner patch, a screen, or any combination thereof.

8. A release mechanism comprising:

a shifting sleeve disposed about a mandrel, wherein the shifting sleeve and the mandrel are configured to substantially prevent rotational movement of the shifting sleeve about the mandrel, and wherein the shifting sleeve is configured to shift between a first position and a second position with respect to the mandrel; and a collet prop disposed about the mandrel, wherein the collet prop is retained in engagement with a collet and the shifting sleeve when the shifting sleeve is in the first position, and wherein the collet prop is configured to longitudinally translate and to disengage the collet prop from the collet in response to a rotational force when the shifting sleeve is disposed in the second position.

9. The release mechanism of claim 8, wherein the collet is configured to fixedly engage a downhole component when the collet prop is engaged with the collet.

10. The release mechanism of claim 8, wherein the collet is configured to releasably engage a downhole component when the collet prop is longitudinally translated out of engagement with the collet.

11. The release mechanism of claim 8, wherein the shifting sleeve comprises a piston comprising a chamber that is in fluid communication with an interior flowbore of the mandrel.

12. The release mechanism of claim 11, wherein the piston is configured to shift from the first position to the second position in response to a pressure applied to the chamber.

13. The release mechanism of claim 8, further comprising a retaining mechanism engaged with the shifting sleeve and the mandrel, and wherein the retaining mechanism is configured to prevent a longitudinal movement of the shifting sleeve until a force above a threshold is applied to the retaining mechanism.

14. The release mechanism of claim 13, wherein the retaining mechanism comprises a shear pin, a shear ring, a shear screw, or any combination thereof.

15. The release mechanism of claim 8, wherein the configuration of the shifting sleeve and mandrel to substantially prevent rotational movement of the shifting sleeve about the mandrel comprises one or more splines disposed on an outer surface of the mandrel, and one or more features disposed on the shifting sleeve that are configured to engage the one or more splines.

16. The release mechanism of claim 8, wherein the configuration of the collet prop to longitudinally translate in response to a rotational force comprises the use of a force conversion mechanism configured to convert a rotational force into a longitudinal force.

17. The release mechanism of claim 16, wherein the force conversion mechanism comprises at least one of a threaded engagement between the collet prop and the mandrel, a helical groove disposed in an outer surface of the mandrel and one or more corresponding lugs disposed on an inner surface of the collet prop, a helical groove disposed in an inner surface of the collet prop and one or more corresponding lugs disposed on an outer surface of the mandrel, or a helical spline disposed in an outer surface of the mandrel and one or more corresponding splines disposed on an inner surface of the collet prop.

18. A method comprising:

longitudinally translating a shifting sleeve out of engagement with a collet prop, wherein the shifting sleeve is disposed about a mandrel;

applying a rotational force to the collet prop or the mandrel when the collet prop is out of engagement with the shifting sleeve;

longitudinally translating the collet prop based on the rotational force; and disengaging the collet prop from a collet based on the longitudinal translation of the collet prop.

19. The method of claim 18, wherein longitudinally translating the shifting sleeve comprises applying a pressure to a chamber disposed between the shifting sleeve and a mandrel about which the shifting sleeve is disposed.

20. The method of claim 18, further comprising disengaging the collet from a downhole component when the collet prop is disengaged from the collet.

* * * * *